US010217418B2

(12) United States Patent
Kim et al.

(10) Patent No.: US 10,217,418 B2
(45) Date of Patent: Feb. 26, 2019

(54) ORGANIC LIGHT EMITTING DIODE DISPLAY DEVICE CAPABLE OF MAINTAINING HIGH BRIGHTNESS AND COLOR TEMPERATURE

(71) Applicant: LG Display Co., Ltd., Seoul (KR)

(72) Inventors: Tae Gung Kim, Gyeonggi-do (KR); Jung Hyeon Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 60 days.

(21) Appl. No.: 14/972,398

(22) Filed: Dec. 17, 2015

(65) Prior Publication Data

US 2016/0189634 A1 Jun. 30, 2016

(30) Foreign Application Priority Data

Dec. 29, 2014 (KR) ..... 10-2014-0191887

(51) Int. Cl.
*G09G 3/34* (2006.01)
*G09G 3/20* (2006.01)
(Continued)

(52) U.S. Cl.
CPC ..... *G09G 3/3406* (2013.01); *G09G 3/2003* (2013.01); *G09G 3/3225* (2013.01); *G09G 3/3233* (2013.01); *G09G 2300/0452* (2013.01); *G09G 2320/029* (2013.01); *G09G 2320/0233* (2013.01); *G09G 2320/0242* (2013.01); *G09G 2320/0285* (2013.01); *G09G 2320/045* (2013.01); *G09G 2320/048* (2013.01); *G09G 2320/064* (2013.01);
(Continued)

(58) Field of Classification Search
CPC ... G09G 2300/0452; G09G 2320/0233; G09G 2320/0242
See application file for complete search history.

(56) References Cited

U.S. PATENT DOCUMENTS

2005/0168490 A1 8/2005 Takahara
2008/0170004 A1* 7/2008 Jung ..... G09G 3/3233 345/76
(Continued)

FOREIGN PATENT DOCUMENTS

CN 101221727 A 7/2008
CN 103871358 A 6/2014
(Continued)

OTHER PUBLICATIONS

Office Action dated Jun. 14, 2017 from KIPO in counterpart KR Application No. 10-2014-0191887.
(Continued)

*Primary Examiner* — Chun-Nan Lin
(74) *Attorney, Agent, or Firm* — Morgan, Lewis & Bockius LLP

(57) ABSTRACT

An organic light emitting diode display device is disclosed which adjusts brightnesses and color temperatures of RGBW data signals and matches the brightnesses of organic light emitting diodes and the color temperature of a white organic light emitting diode with the target brightness value and the target color temperature of a white pixel. As such, an overcompensation and the reduction of a lifespan can be prevented. Also, relatively high brightness and color temperature can be maintained.

7 Claims, 8 Drawing Sheets

(51) Int. Cl.
*G09G 3/3233* (2016.01)
*G09G 3/3225* (2016.01)

(52) U.S. Cl.
CPC ..... *G09G 2320/0626* (2013.01); *G09G 2320/0666* (2013.01); *G09G 2330/021* (2013.01)

(56) References Cited

U.S. PATENT DOCUMENTS

| | | | | |
|---|---|---|---|---|
| 2013/0082589 | A1* | 4/2013 | So | H01L 51/5036 313/504 |
| 2013/0147693 | A1 | 6/2013 | Bae | |
| 2014/0071189 | A1* | 3/2014 | Park | G09G 5/02 345/694 |
| 2014/0160142 | A1 | 6/2014 | Lee et al. | |

FOREIGN PATENT DOCUMENTS

| | | | |
|---|---|---|---|
| JP | 2003150082 | A | 5/2003 |
| JP | 2005164862 | A | 6/2005 |
| KR | 10-2007-0092766 | A | 9/2007 |
| KR | 1020130064552 | A | 6/2013 |

OTHER PUBLICATIONS

European Search Report dated Jul. 13, 2016, for corresponding European Patent Application No. 15197724.6.

First Notification of Office Action dated Oct. 31, 2017 from The State Intellectual Property Office of China in counterpart CN Application No. 201511017397.6.

Notice of Allowance dated Jun. 29, 2018, issued in counterpart Korean Patent Application No. 10-2018-0050871.

* cited by examiner

ORGANIC LIGHT EMITTING DIODE DISPLAY DEVICE CAPABLE OF MAINTAINING HIGH BRIGHTNESS AND COLOR TEMPERATURE

The present application claims priority under 35 U.S.C. § 119(a) of Korean Patent Application No. 10-2014-0191887 filed on Dec. 29, 2014 which is hereby incorporated by reference in its entirety.

BACKGROUND

Field of the Disclosure

The present application relates to an organic light emitting diode display device with the same.

Description of the Related Art

Recently, a variety of flat panel display (FPD) devices adapted to reduce weight and volume corresponding to disadvantages of cathode ray tube (CRT) are being developed. The flat panel display devices include liquid crystal display (LCD) devices, field emission display (FED) devices, plasma display panels (PDPs), electroluminescence devices and so on.

The PDPs have advantages such as simple structure, simple manufacture procedure, lightness and thinness, and are easy to provide a large-sized screen. In view of these points, the PDPs attract public attention. However, the PDPs have serious problems such as low light emission efficiency, low brightness and high power consumption. Also, thin film transistor LCD devices use thin film transistors as switching elements. Such thin film transistor LCD devices are being widely used as the flat display devices. However, the thin film transistor LCD devices have disadvantages such as a narrow viewing angle and a low response time, because of being non-luminous devices. Meanwhile, the electroluminescence display devices are classified into an inorganic light emitting diode display device and an organic light emitting diode display device on the basis of the formation material of a light emission layer. The organic light emitting diode display device corresponding to a self-illuminating display device has features such as high response time, high light emission efficiency, high brightness and wide viewing angle.

The organic light emitting diode display device controls a voltage between a gate electrode and a source electrode of a driving transistor. As such, a current flowing from a drain electrode of the driving transistor toward a source electrode of the driving transistor can be controlled.

The current passing through the drain and source electrodes of the driving transistor is applied to an organic light emitting diode and allows the organic light emitting diode to emit light. Light emission quantity of the organic light emitting diode can be controlled by adjusting the current quantity flowing into the organic light emitting diode.

The organic light emitting diode is proportionally stressed by the current flowing through it. Due to this, the organic light emitting diode must deteriorate and furthermore have low brightness with respect to the same current.

Also, a white organic light emitting diode can realize white by combining several color emission layers. For example, the white organic light emitting diode is formed in a multi-layered structure including yellow, green and blue emission layers. As such, when the white organic light emitting diode has been under a stress, degrees of the stress affecting the yellow, green and blue color emission layers must be different from one another. A CCT (correlated color temperature) of white must be different from a target value (or a desired value). Due to this, a residual image and an image stitch phenomenon and so on can be caused by the deterioration of the organic light emitting diode.

To address this matter, bottom-up and top-down compensation methods are being used to compensate the deterioration of the organic light emitting diode.

FIG. 1 is a data sheet illustrating a bottom-up compensation method. FIG. 2 is a data sheet is a data sheet illustrating a top-down compensation method.

Referring to FIG. 1, the bottom-up compensation method increases brightness of each pixel from an ideal value in proportion with a degree of the stress of the respective pixel. As such, power consumption must increase and the stress applied to the pixel must be weighted. Meanwhile, as shown in FIG. 2, the top-down compensation method decreases brightness of each pixel from a brightness value of a pixel, which is exposed to the greatest stress, in inverse proportion to a degree of the stress of the respective pixel. However, the top-down compensation method decreases brightness of a normal organic light emitting diode display device below a desired specification. As such, the lifespan of the organic light emitting diode display device must be reduced. Moreover, it is difficult to determine a decrement degree of the brightness for the organic light emitting diode display device.

FIG. 3 is a data sheet illustrating a CCT compensation method. As shown in FIG. 3, a blue organic emission layer of the organic light emitting diode has a shorter lifespan compared to the yellow organic emission layer of the organic light emitting diode. As such, the blue organic emission layer easily deteriorates and varies a color coordinator of the white organic light emitting diode. Therefore, a compensation of increasing brightness of the blue organic emission layer can be performed for the white organic light emitting diode. Due to this, the blue organic emission layer must be exposed to a more serious stress and the deterioration of the blue organic emission layer must be more accelerated.

BRIEF SUMMARY

Accordingly, embodiments of the present application are directed to an organic light emitting diode display device that substantially obviates one or more of problems due to the limitations and disadvantages of the related art, as well to a light source module and a backlight unit each using the same.

The embodiments are to provide an organic light emitting diode display device which is adapted to prevent an over-compensation and a lifespan reduction and realize high brightness and color temperature.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

An organic light emitting diode display device according to a general aspect of the present embodiment can prevent not only the generation of a non-controllable state due to the high (or excessive) stress in the related art bottom-up compensation method but also a brightness decrement and a falling of the color temperature below the desired range in the related art top-down compensation method, through a compensation procedure which uses a target value. Therefore, the lifespan reduction can be prevented, relatively high brightness and color temperature can be maintained, and the stress can be minimized.

Also, a compensation value in correspondence with the target value is always used in the compensation procedure. Therefore, a display panel can maintain the same image quality regardless of an deteriorated degree of each pixel.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
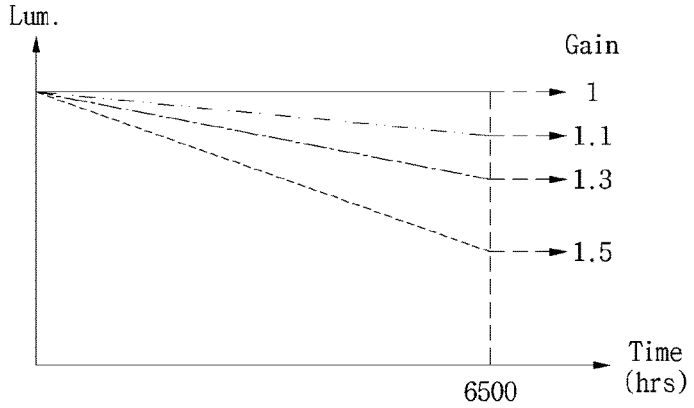
FIG. 1 is a data sheet illustrating a bottom-up compensation method.

Reference will now be made in detail to a data conversion unit and an organic light emitting diode display device with the same in accordance with the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

Advantages and features of the present disclosure, and implementation methods thereof will be clarified through the following embodiments described with reference to the accompanying drawings. These embodiments introduced hereinafter are provided as examples in order to convey their spirits to the ordinary skilled person in the art. As such, these embodiments might be embodied in a different shape, so are not limited to these embodiments described here. Therefore, the present disclosure must be defined by scopes of claims. The same reference numbers will be used throughout this disclosure to refer to the same or like parts. The size or the relative size of a layer or a region in the drawings can be exaggerated for the definiteness of explanation.

In the description of embodiments, when an element or a layer is described as being disposed "on or above" another element or layer, this description should be construed as including a case in which the elements or layers contact each other as well as a case in which a third element or layer is interposed therebetween. On the contrary, if an element is described as being "directly on" or "just on" another element, it is represented that any third element is not interposed therebetween.

The relative spatial terms, such as "below or beneath", "lower", "above", "upper" and so on, are used for easily explaining mutual relations between "a component or components" and "another component or different components" shown in the drawings. As such, the relative spatial terms should be construed as including a direction of the component shown in the drawings as well as different directions of the component from one another at a use or an operation. For example, when an element reversely shown in the drawings is described as being disposed "below or beneath" another element, the element can be disposed "above" another element. Therefore, "below or beneath" used as an example of the relative spatial term can include both of "below or beneath" and "above".

The terms within the present disclosure are used for explaining embodiments, but they do not limit the present disclosure. As such, the singular forms used in the present disclosure are intended to include the plural forms, unless the context clearly indicates otherwise. The terms "comprises" and/or "comprising" described in the present disclosure specify the presence of stated components, steps, operations and/or elements, but do not preclude the presence or addition of one or more other components, steps, operations, elements and/or groups thereof.

[Structure of Organic Light Emitting Diode]

FIG. 1 is a schematic diagram showing the structure of an organic light emitting diode.

An organic light emitting diode display device can include organic light emitting diodes shown in FIG. 1.

The organic light emitting diode can include organic compound layers HIL, HTL, EML, ETL and EIL formed between an anode electrode and a cathode electrode.

The organic compound layers can include a hole injection layer HIL, a hole transport layer HTL, an emission layer EML, an electron transport layer ETL and an electron injection layer EIL.

If a driving voltage is applied between the anode electrode and the cathode electrode, holes passing through the hole transport layer HTL and electrons passing through the electron transport layer ETL are drifted into the emission layer EML. As such, excitons are formed within the emission layer EML. In accordance therewith, visual light can be emitted from the emission layer EML.

Also, the emission layer EML can include one of a red emission layer displaying red, a green emission layer displaying green and a blue emission layer displaying blue according whether any one of colors is displayed by the respective organic light emitting diode. The red emission layer, the green emission layer and the blue emission layer can be prepared by differently doping different types of dopants in different densities. Alternatively, the emission layer EML can be formed in a stacked structure of the red emission layer, the green emission layer and the blue emission layer in order to provide a white organic light emitting diode.

The organic light emitting diode display device is configured with pixels, which are arranged in a matrix shape and each include the above-mentioned organic light emitting diode. Brightness of the pixel selected by a scan pulse can be controlled on the basis of a gray value of digital video data.

Such an organic light emitting diode display device can be classified into a passive matrix mode and an active matrix mode which uses thin film transistors as switch elements.

Among the organic light emitting diode display devices, the active matrix mode selects the pixels by selectively turning-on the thin film transistors. The selected pixel can maintain a light emitting state using a voltage charged into a storage capacitor within the pixel.

[Equivalent Circuit Diagram of Active Matrix Mode Pixel]

Figure 2:
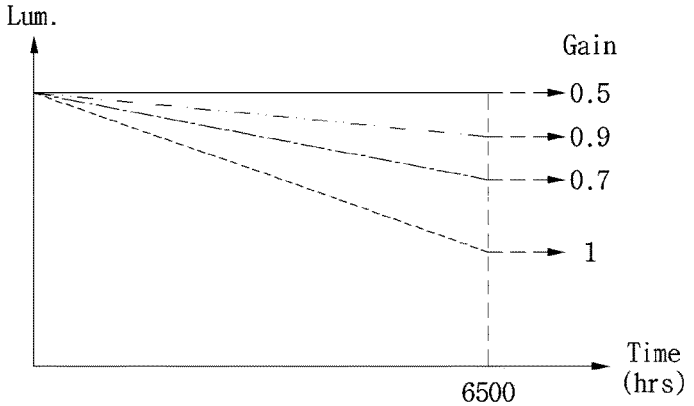
FIG. 2 is a data sheet is a data sheet illustrating a top-down compensation method.

FIG. 2 is an equivalent circuit diagram showing a single pixel included in an organic light emitting diode display device according to an embodiment of the present disclosure.

Referring to FIG. 2, each of the pixels within the organic light emitting diode display device according to an embodiment of the present disclosure includes an organic light emitting diode OLED, a data line D and a gate lines G, a scan switch SW configured to transfer a data voltage on the data line D in response to a scan pulse SP on the gate line G, a driving switch DR configured to generate a current on the basis of a voltage between gate and source electrodes, and a storage capacitor Cst configured to store the data voltage and maintain the data voltage for a fixed period. As the scan switch SW and the driving switch DR, n-type MOS-FETs (metal oxide semiconductor-field effect transistors) can be used.

Such a configuration including two transistors SW and DR and one capacitor Cst is called a 2T-1C configuration.

The scan switch SW is turned-on (or activated) in response to a scan pulse SP from the gate line G. As such, a current path between a source electrode and a drain electrode of the switching switch SW is formed.

During a turned-on time interval of the scan switch SW, a data voltage is transferred from the data line D to a gate electrode of the driving switch DR and the storage capacitor Cst via the source electrode and the drain electrode of the scan switch SW.

The driving switch DR controls a current (or a current quantity) flowing through the organic light emitting diode OLED on the basis of a different voltage Vgs between the gate electrode and a source electrode of the driving switch DR.

The storage capacitor Cst stores the data voltage applied to its one electrode. Such a storage capacitor Cst constantly maintains the voltage applied to the gate electrode of the driving switch DR during a single frame period.

Figure 4:
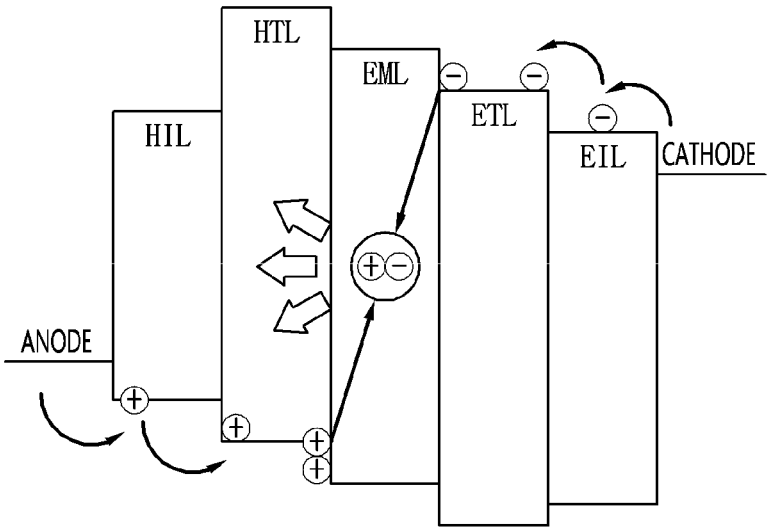
FIG. 4 is a schematic diagram showing the structure of an organic light emitting diode.

The organic light emitting diode OLED with the configuration shown in FIG. 4 is connected between the source electrode of the driving switch DR and a low potential driving voltage line Vss. The low potential driving voltage line Vss is connected to a low potential driving voltage source Vss not shown in the drawing.

The current flowing through the organic light emitting diode OLED is proportioned to brightness of the pixel. Also, the current flowing through the organic light emitting diode OLED depend on the voltage between the gate and source electrodes of the driving switch DR.

[Configuration of Organic Light Emitting Diode Display Device]

Figure 3:
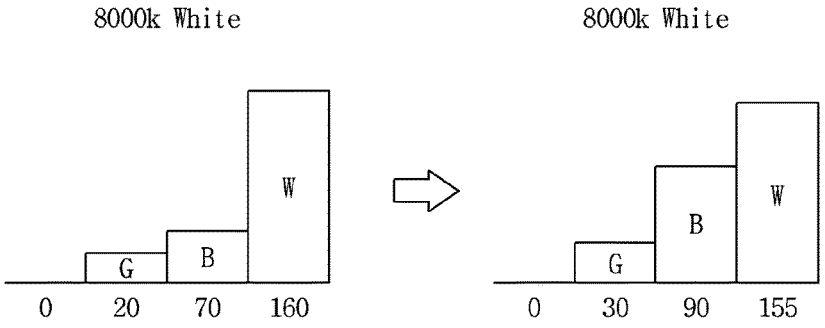
FIG. 3 is a data sheet illustrating a CCT compensation method.

FIG. 3 is a block diagram showing an organic light emitting diode display device according to an embodiment of the present disclosure.

Referring to FIG. 3, an organic light emitting diode display device according to an embodiment of the present disclosure can include a display panel 116, a gate driver 118, a data driver 120, a timing controller 124 and a data conversion unit 300.

The display panel 116 can include m data lines D1~Dm, m sensing lines S1~Sm, n gate lines G1~Gn and n sensing control lines SC1~SCn and m×n pixels 122. The m data lines D1~Dm and the m sensing lines S1~Sm are opposite to each other one by one and form m pairs. Similarly, the n gate lines G1—Gn and the n sensing control lines SC1~SCn are opposite to each other one by one and form n pairs. Pixels 122 can be formed in regions which are defined by crossing the m pairs of the data lines D and the sensing lines S and the n pairs of the gate lines G and the sensing control lines SC.

Also, first signal lines used to apply a first driving voltage Vdd to each of the pixels 122 and second signal lines used to apply a second driving voltage Vss to each of the pixels 122 can be formed on the display panel 116. The first driving voltage Vdd can be generated in a high potential driving voltage source Vdd not shown in the drawing. The second driving voltage Vss can be generated in a low potential driving voltage source Vss not shown in the drawing.

The timing controller 124 can receive timing signals, such as a vertical synchronous signal Vsync, a horizontal synchronous signal Hsync, a dot clock signal DCLK, a data enable signal DE and so on, from an external graphic controller (not shown). Also, the timing controller 124 can derive data and gate control signals DDC and GDC from the received timing signals. The data control signals DDC are used to control operation timings of the data driver 120. The gate control signals GDC are used to control operation timings of the gate driver 118.

The data conversion unit 300 can convert three colored digital video data RGB from the exterior (for example, the external graphic controller) into four colored digital video data RGBW. Also, the data conversion unit 300 can compensate brightness of the four colored digital video data RGBW and a color temperature of white data. The compensated digital video data RGBW is applied from the data conversion unit 300 to the timing controller 124. Then, the timing controller 124 can rearranges the compensated digital video data RGBW into a format suitable for definition of the display panel 116. The rearranged digital video data RGBW is applied from the timing controller 124 to the data driver 120.

The gate driver 118 can generate scan pulses in response to gate control signals GDC from the timing controller 124. The scan pulses can be sequentially applied from the gate driver 118 to the gate lines G1~Gn on the display panel 116.

Also, the gate driver 118 can output sensing control signals SCS to the sensing control lines SC1~SCn on the display panel 116 under control of the timing controller 124. The sensing control signal SCS is used to control a sensing switch (not shown) included in each of the pixels.

Although it is explained that the gate driver 118 outputs both of the scan pulses SP and the sensing control signals SCS, but the present disclosure is not limited to this. Alternatively, the organic light emitting diode display device can additionally include a sensing switch control driver which outputs the sensing control signals SCS under control of the timing controller 124.

The data driver 120 can be controlled by data control signals DDC applied from the timing controller 124. Also, the data driver 120 can apply a sensing voltage to the sensing lines S1~Sm. Also, the data driver 120 can apply analog data voltages to the data lines D1~Dm on the display panel 116. In order to apply the data voltages to the data lines D1~Dm, the data driver 120 can convert the four colored digital video data RGBW, which is compensated by the data conversion unit 300 in brightness and color temperature and applied from the data conversion unit 300 via the timing controller 124, into the analog data voltages.

The data lines D1~Dm are connected to the pixels 122. As such, the data voltages can be transferred to the pixels 122 via the data lines D1~Dm.

The sensing lines S1~Sm are connected to the pixels 122. Such sensing lines S1~Sm can be used to not only apply the sensing voltage to the pixels 122 but also measure the sensing voltages. The sensing voltage can be obtained by charging an initialization voltage into the pixels through the respective sensing lines S and the entering the pixels in a floating state. Although it is explained that the data driver 120 can output the data voltage and the sensing voltage and detect the sensing voltage, the present disclosure is not limited to this. Alternatively, the organic light emitting diode display device can additionally include a sensing driver which outputs the sensing voltage and detects the sensing voltage.

Meanwhile, the data conversion unit 300 can be built in the timing controller 124. Alternatively, the data conversion unit 300 is disposed separately from the timing controller 124 in the organic light emitting diode display device. Also, it is described that the data conversion unit 300 is applied to the organic light emitting diode display device, the present disclosure is not limited to this. In other words, the data conversion unit 300 can be applied to wireless communication devices, such as wireless mobile handsets, digital cameras, video cameras, digital multi-players, personal digital assistances PDAs, video game consoles, different type video devices and exclusive viewing stations (such as television receivers).

[Configuration of Pixel]

Figure 7:
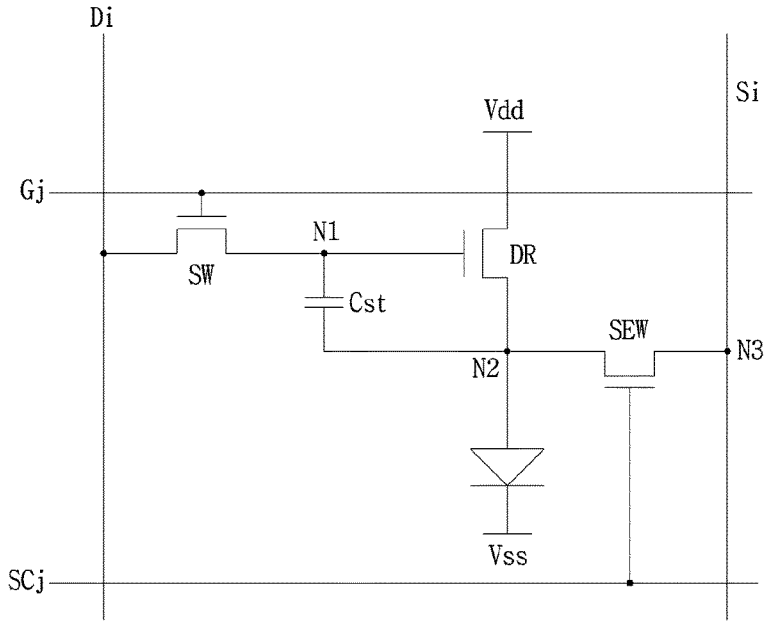
FIG. 7 is a circuit diagram showing the configuration of a single pixel according to an embodiment of the present disclosure.

FIG. 7 is a circuit diagram showing a configuration of a pixel according to an embodiment of the present disclosure.

The pixel 122 disclosed in the present disclosure can be one of red, green, blue and white pixels. Also, the pixel 122 can be called a sub-pixel.

The sub-pixel 122 can include a scan switch SW, a driving switch DR, a sensing switch SEW, an organic light emitting diode OLED and a storage capacitor Cst.

The scan switch SW can be a transistor used to transfer the data voltage on the data line Di. The scan switch SW can be controlled by the scan pulse SP on the gate line Gj and connected between the data line Di and a first node N1.

The driving switch DR can be a transistor which adjusts a current flowing through the organic light emitting diode OLED by a voltage between the first node N1 and a second node N2 connected to a gate electrode and a source electrode of the transistor. As such, the driving switch DR can include a gate electrode connected to the first node N1, a source electrode connected to the second node N2 and a drain electrode connected to the first driving voltage line Vdd.

The sensing switch SEW can be a transistor which is used to initialize the second node N2 and detect a threshold voltage of the driving switch DR via the sensing line Si. Such a sensing switch SEW can be controlled by the sensing control signal SCS on the sensing control line SCj and connected between the second node N2 and a third node N3.

The organic light emitting diode OLED includes an anode electrode and a cathode electrode. The anode electrode can be connected to the second node N2 and the cathode electrode can be connected to the second driving voltage line Vss.

The storage capacitor Cst can be connected between the first and second nodes N1 and N2. In other words, the storage capacitor Cst can be connected between the gate and source electrodes of the driving switch DR.

[Deterioration Compensation of Organic Light Emitting Diode Display Device by Timing Controller]

Figure 5:
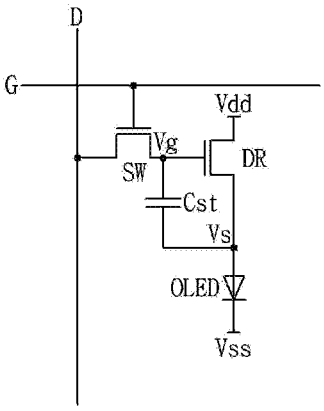
FIG. 5 is an equivalent circuit diagram showing a single pixel included in an organic light emitting diode display device according to an embodiment of the present disclosure.
Figure 6:
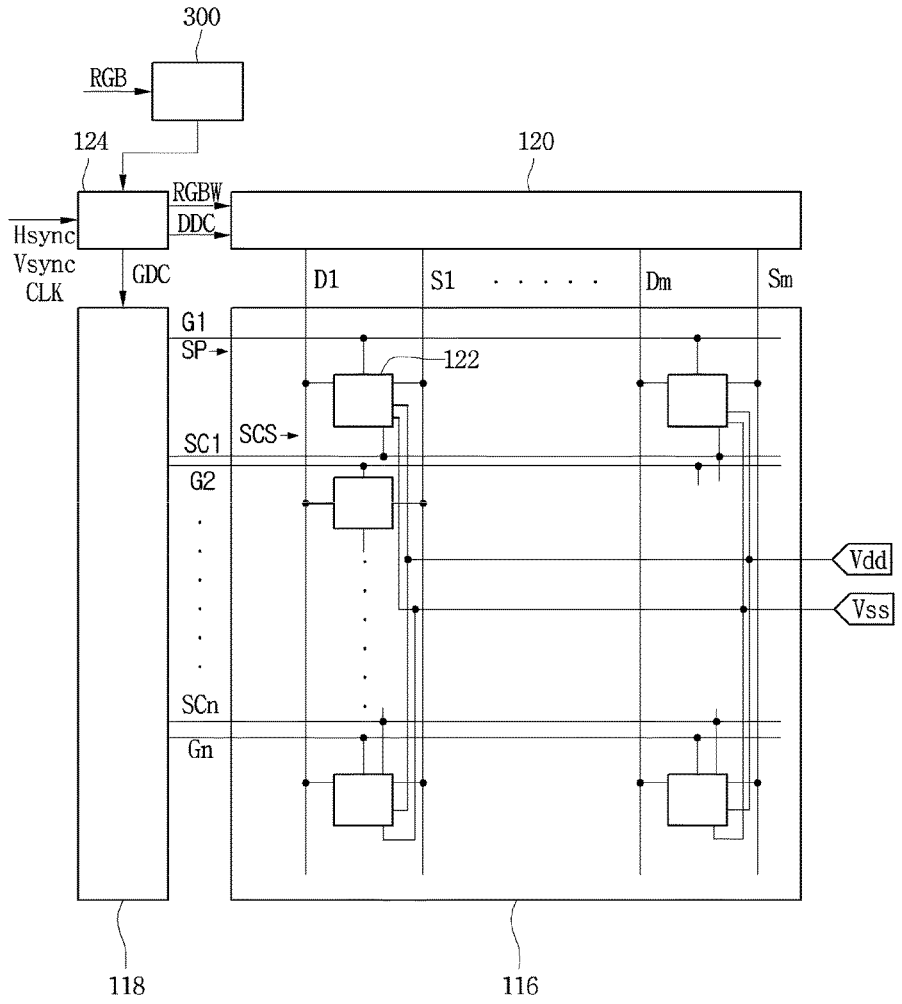
FIG. 6 is a block diagram showing an organic light emitting diode display device according to an embodiment of the present disclosure.
Figure 8A:
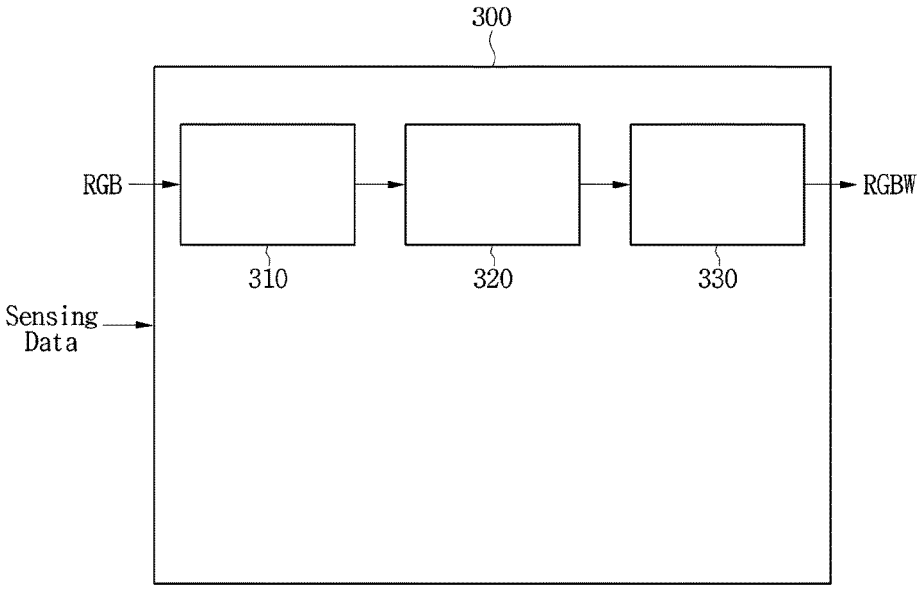
FIG. 8A is a detailed block diagram showing the data conversion unit of FIG. 5.
Figure 8B:
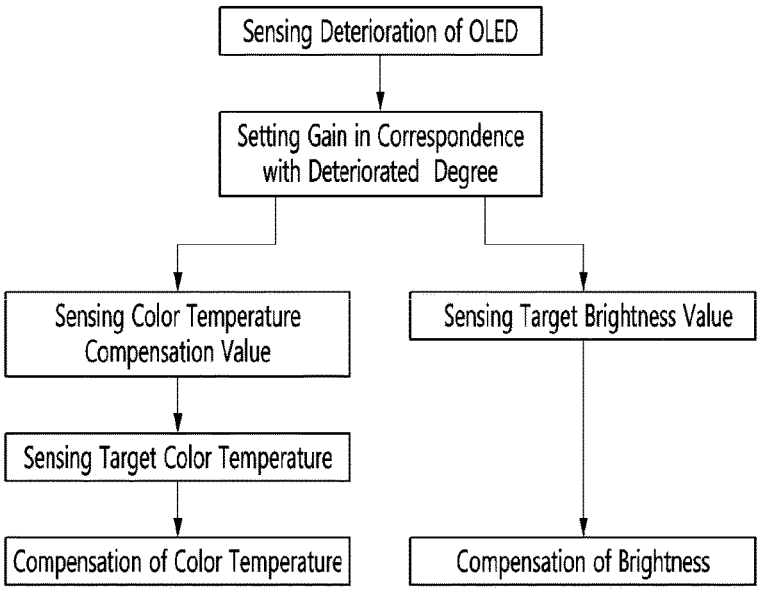
FIG. 8B is a flow chart illustrating an operation of the data conversion unit.
Figure 9:
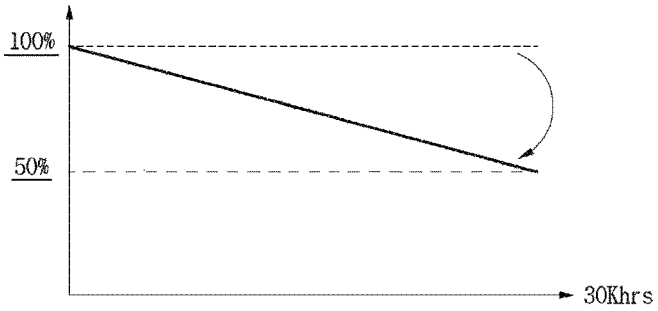
FIG. 9 is a data sheet illustrating a target brightness value used in compensation of decreased brightness.
Figure 10:
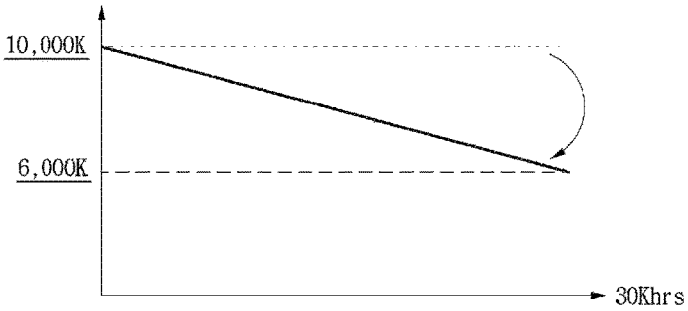
FIG. 10 is a data sheet illustrating a target color temperature used in a compensation of color temperature.

FIG. 8A is a detailed block diagram showing the data conversion unit of FIG. 5. FIG. 8B is a flow chart illustrating an operation of the data conversion unit. FIG. 9 is a data sheet illustrating a target brightness value used in a compensation of deteriorated brightness. FIG. 10 is a data sheet illustrating a target color temperature used in a compensation of color temperature. A vertical axis in FIG. 9 represents brightness, and a vertical axis in FIG. 10 represents color temperature.

Referring to FIG. 8A, the data conversion unit 300 can include a de-gamma portion 310, a three-to-four color transform portion 320 (hereinafter, 'RGB-RGBW transform portion 320') and a deterioration compensator 330.

The de-gamma portion 310 can input red R, green G and blue B data signals of image data and perform a de-gamma treatment for the input RGB data signals in a frame unit. Also, the de-gamma portion 310 can performs a bit-stretch treatment for the de-gamma-treated RGB data signals. More specifically, the de-gamma portion 310 compensates an inverse gamma, which is included in the input RGB data signals, through the de-gamma treatment. As such, the (de-gamma)-treated RGB signals can have a linear property. Also, the de-gamma portion 310 can increase the de-gamma-treated RGB data signals in the number of bits through the bit stretch treatment. In accordance therewith, the generation of a bit overflow phenomena at data operations, which are performed for converting the RGB data signals into red R, green G, blue B and white W data signals, can be prevented. Such a de-gamma portion 310 can simultaneously perform the de-gamma treatment and the bit stretch treatment using a de-gamma LUT (look-up-table).

The RGB-RGBW transformation portion 320 can convert the RGB data signals, which are applied from the de-gamma portion 310, into the RGBW data signals. The RGBW data signals obtained by the RGB-RGBW transformation portion 320 are used to drive a display panel including RGBW sub-pixels. In order to optimize power consumption without changing color coordinates, the RGB-RGBW transformation portion 320 can add a W data signal including RGB data components, which are based on measured or estimated values having the same brightness and color coordinate as a W data component, and perform subtractions of the RGB data components from the (de-gamma)-treated RGB data signals. For example, the RGB-RGBW transformation portion 320 can generate the W data signal by extracting one of a common gray value, which is represented by equation 1, and a minimum gray value, which is represented by equation 2, from the (de-gamma)-treated RGB data signal. Also, the RGB-RGBW transformation portion 320 can generate secondary RGB data signals by subtracting the W data signal from each of the (de-gamma)-treated RGB data signals.

$$W=Com(R,G,B) \quad \text{[Equation 1]}$$

$$W=Min(R,G,B) \quad \text{[Equation 2]}$$

In another different manner, the RGB-RGBW transformation portion 320 can convert R, G and B data signals into four color data signal, which include R, G, B and W data signals, using data conversion methods which are based on properties of each sub-pixel such as a brightness property of the sub-pixel and a driving property of the sub-pixel.

Also, the RGB-RGBW transform portion 320 can generate the W data signals with color temperatures corresponding to a target color temperature of the W pixels when the W data signal is derived from the RGB data signals.

The deterioration compensator 330 can update sensing data including deterioration information. Also, the deterioration compensator 330 can perform a brightness compensation for each of the RGBW data signals, which are applied from the RGB-RGBW transform portion 320, and allows each of the compensated RGBW data signals to have brightness corresponding to a target brightness value.

Referring to FIG. 8A, the data conversion unit 300 can receive the sensing data with the deterioration information of the organic light emitting diode OLED from one of the timing controller 124, the data driver 120 and an additional sensing driver (not shown). Also, the data conversion unit 300 can set a compensation brightness gain Gain of the image data on the basis of the deterioration information of the organic light emitting diode. The compensation brightness gain Gain can be set to be a proper value which allows the deteriorated organic light emitting diode to be same to have the same brightness as its initial state (or an initial organic light emitting diode) without any deterioration with respect to the same image data. In other words, the compensation brightness gain Gain can be differently set on the basis of a deteriorated degree of the organic light emitting diode OLED (or the pixels).

The data conversion unit 300 can also set a target brightness value and a target color temperature of the W pixel (or the white organic light emitting diode OLED).

TABLE 1

| | Display period (Continuously driven period of OLED) | | | |
|---|---|---|---|---|
| | One hour | Two hours | Three hours | Four hours |
| CBG1 | TBV1-1 | TBV1-2 | TBV1-3 | TBV1-4 |
| CBG2 | TBV2-1 | TBV2-2 | TBV2-3 | TBV2-4 |
| CBG3 | TBV2-1 | TBV3-2 | TBV3-3 | TBV3-4 |
| CBG4 | TBV3-1 | TBV4-2 | TBV4-3 | TBV4-4 |
| CBG5 | TBV5-1 | TBV5-2 | TBV5-3 | TBV5-4 |

In table 1, "CBG" represents a compensation brightness gain and "TBV" represents a target brightness value.

A method of setting target brightness values will now be described with reference to the table 1. The target brightness values can be determined in consideration of the above-mentioned compensation brightness gain CBG and a display period (or a continuously driven period of the organic light emitting diode OLED). In detail, the compensation brightness gain CBG can be set in a varying manner with a deteriorated degree of the organic light emitting diode, in order to enable brightness of the deteriorated organic light emitting diode OLED to be equal to that of its initial state without any deterioration. In other words, the target brightness gain CBG can become one of first through fifth target brightness gains CBG1~CBG5 on the basis of the deteriorated degree of the organic light emitting diode OLED. The target brightness value can be determined on the basis of the compensation brightness gain CBG and the display period. In other words, the target brightness value can be set to be one of first through fifth target brightness values TBV1~TBV5 on the basis of the compensation brightness gain CBG. Each of the first through fifth target brightness values TBV1~TBV5 can be set to be one of first through fourth time-rated brightness values TBVk-1~TBVk-4 on the basis of the display period. The numeral 'k' is one of 1~5.

For example, the compensation brightness gain CBG can be set to be the second compensation brightness gain CBG2 by the deteriorated degree of the organic light emitting diode OLED. The second compensation brightness gain CBG2 is used in the brightness compensation of the organic light emitting diode OLED and enables the brightness of the deteriorated organic light emitting diode OLED to be equal to that of its initial state without any deterioration. In this case, the target brightness value TBV can be set to be one of the first through fourth time-rated target brightness values TBV2-1~TBV2-4, which belong to the second target brightness value TBV2, on the basis of the display period. The numbers of compensation brightness gains CBG, target brightness values TBV and time-rated target brightness values TBVk-1~TBVk-4 and the ranges (or lengths) of the display periods are not limited to those of Table 1.

The present disclosure does not use directly the compensation brightness gain CBG, which is obtained from the deteriorated degree of the organic light emitting diode OLED, in the brightness compensation. Instead of the compensation brightness gain, the present disclosure performs the deterioration compensation of the organic light emitting diode OLED using the target brightness value TBV which is obtained by considering the compensation brightness gain CBG and the display period. As such, the stress caused by an over-compensation and the lifespan reduction caused by an under-compensation can be simultaneously prevent.

The color temperature compensation value CTCV of the W pixel (or an white organic light emitting diode OLED) used in a color temperature compensation can be determined on the basis of the compensation brightness gain which is based on the deteriorated degree of the organic light emitting diode OLED. The color temperature compensation value CTCV of the W pixel enables the color temperature of the deteriorated organic light emitting diode OLED to be equal to that of its initial state without any deterioration, with respect to the same white data signal. Also, a target color temperature TCT of the W pixel (or the white organic light emitting diode OLED) can be set on the basis of the color temperature compensation value CTCV of the W pixel signal and the display period.

TABLE 2

| | Display period (Continuously driven period of OLED) | | | |
|---|---|---|---|---|
| | One hour | Two hours | Three hours | Four hours |
| CTCV1 | TCT1-1 | TCT1-2 | TCT1-3 | TCT1-4 |
| CTCV2 | TCT2-1 | TCT2-2 | TCT2-3 | TCT2-4 |
| CTCV3 | TCT3-1 | TCT3-2 | TCT3-3 | TCT3-4 |
| CTCV4 | TCT4-1 | TCT4-2 | TCT4-3 | TCT4-4 |
| CTCV5 | TCT5-1 | TCT5-2 | TCT5-3 | TCT5-4 |

In table 2, "CTCV" represents a color temperature compensation value and "TCT" represents a target color temperature.

Referring to Table 2, the color temperature compensation value CTCV of the W pixel is used for compensating a color temperature of the deteriorated organic light emitting diode OLED and allows the color temperature of the deteriorated organic light emitting diode OLED to be equal to that of the initial organic light emitting diode OLED without any deterioration. Such a color temperature compensation value CTCV of the W pixel can be varied with a brightness variation which is caused by the deteriorated degree of the organic light emitting diode OLED. In other words, the color temperature compensation value CTCV of the W pixel can be set to be one of first through fifth color temperature compensation values CTCV1~CTCV5 according to the brightness variation which is caused by the deteriorated degree of the organic light emitting diode OLED. The target color temperature TCT can be differently set on the basis of the color temperature compensation value CTCV and the display period (i.e., the continuously driven period of the organic light emitting diode OLED). In other words, the target color temperature TCT can be set one of first through fifth target color temperatures TCT1~TCT5 on the color temperature compensation value CTCV of the W pixel. Also, each of the first through fifth target color temperatures TCT1~TCT5 can be set to be one of first through fourth time-rated target color temperatures TCTk1~TCTk4 according to the display period.

For example, the color temperature compensation value CTCV of the W pixel can be set to be the second color temperature compensation value CTCV2 of the W pixel in consideration of the deteriorated degree of the organic light emitting diode OLED. The second color temperature compensation value CTCV2 is used for compensating the color temperature of the W pixel and enables the color temperature of the deteriorated organic light emitting diode OLED to be equal to that of the initial organic light emitting diode OLED without any deterioration with respect to the same W data signal. In this case, the target color temperature TCT can be set to be one of the first through fifth target color temperature TCT1~TCT5 in correspondence with the second color temperature compensation value CTCV2. Also, the target color temperature TCT can be set to be one of the first through fourth time-rated target color temperatures TCT2-1~TCT2-4 on the basis of the display period. The numbers of target color compensation values CTCV, target color temperatures TCT and time-rated target color temperatures TCTk-1~TCTk-4 and the ranges (or lengths) of the display periods are not limited to those of Table 2.

The present disclosure does not use directly the color temperature compensation value CTCV of the W pixel, which is obtained from the deteriorated degree of the organic light emitting diode OLED, in the brightness compensation. Instead of the color temperature compensation values CTCV, the present disclosure performs the deterioration compensation of the organic light emitting diode OLED, which is used to display white, using the color temperature compensation value CTCV and the target color temperature TCT (i.e., the time-rated target color temperature), which is obtained by considering the color temperature compensation value CTCV of the W pixel and the display period. As such, the stress caused by an over-compensation and the lifespan reduction caused by an under-compensation can be simultaneously prevented.

Each of the target brightness values TBV1~TBV5 (i.e., each of groups of the time-rated target brightness values TBVk-1~TBVk-4) opposite to the compensation brightness gains CBG1~CBG5 can be set in a gradually decreasing manner along the display period as a linear chart shown in FIG. 9. In other words, the time-rated target brightness values TBVk-1~TBVk-4, which are included in the target brightness value TBVk opposite to each of the compensation brightness gains CBG1~CBG5, can be set to be values which are gradually decreased along the display period as the linear chart shown in FIG. 9. For example, the first through fourth time-rated target brightness values TBV3-1~TBV3-4, which are included in the third target brightness value TBV3 opposite to the third compensation brightness gain CBG3, can be set to values which are gradually decreased along the display period.

Also, each of the target color temperatures TCT1~TCT5 (i.e., each of groups of the time-rated target color temperatures TCTk-1~TBVk-4) opposite to the color temperature compensation values CTCV1~CTCV5 of the W pixel can be set in a gradually decreasing manner along the display period as a linear chart shown in FIG. 10. In other words, the time-rated target color temperatures TCTk-1~TCTk-4, which are included in the target color temperature TCTk opposite to each of the color temperature compensation values CTCV1~CTCV5 of the W pixel, can be set to be values which are gradually decreased along the display period as the linear chart shown in FIG. 10. For example, the first through fourth time-rated target color temperatures TCT3-1~TCT3-4, which are included in the third target color temperature TCT3 opposite to the third color temperature compensation value CTCV3 of the W pixel, can be set to values which are gradually decreased along the display period.

Although it is described that the target brightness value TBV and the target color temperature TCT of the W pixel are set in a gradually decreasing manner along the display period as the linear charts shown in FIGS. 9 and 10, the present disclosure is not limited to this. In other words, the target brightness value TBV and the target color temperature TCT of the W pixel can be set in a variety of property charts on the basis of a use environment of the organic light emitting diode, a use pattern of a user, the size of a device and a previously set initial specification. However, the target brightness value TBV and the target color temperature TCT of the W pixel must be set in a decreasing manner along the display period. This results from the fact that the organic light emitting diode OLED must be deteriorated as the display time passes. The target brightness value TBV and the target color temperature TCT of the W pixel can be set in a numerical range which satisfies the specification of a normal organic light emitting diode display device. For example, a proper reference brightness value can be set to be 50% of brightness of the organic light emitting diode display device. In this case, it can be considered that the organic light emitting diode display device normally displays brightness when the organic light emitting diode display device maintains at least 50% of brightness of its initial state. Also, if the color temperature of an initial organic light emitting diode display device is 10,000K and a reference color temperature of the W pixel is set to be 6000K, it can be considered that the organic light emitting diode display device displays the W data signal in a normal color temperature when the organic light emitting diode display device maintains the color temperature of at least 6000K.

In this manner, the data conversion unit 300 and the organic light emitting diode display device with the same according to the present disclosure can compensate the deterioration of the organic light emitting diode OLED using the target brightness value TBV and the target color temperature TCT. In accordance therewith, an extreme stress caused by an over-compensation and difficulties in controlling the brightness and color temperature of the display panel 116 can be thoroughly prevent. Also, a desired specification of the display panel 116 can be satisfied.

Figure 11A:
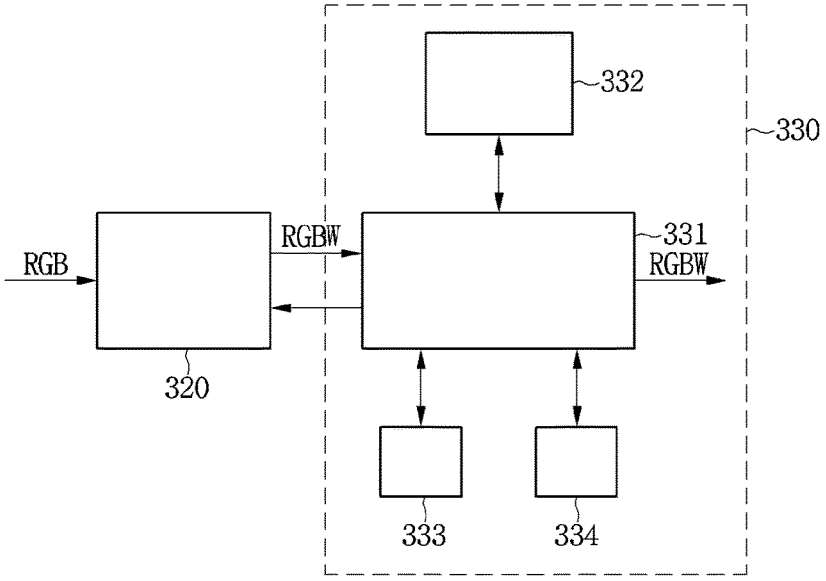
FIG. 11A is a detailed block diagram showing an example of the deterioration compensator in FIG. 7.
Figure 11B:
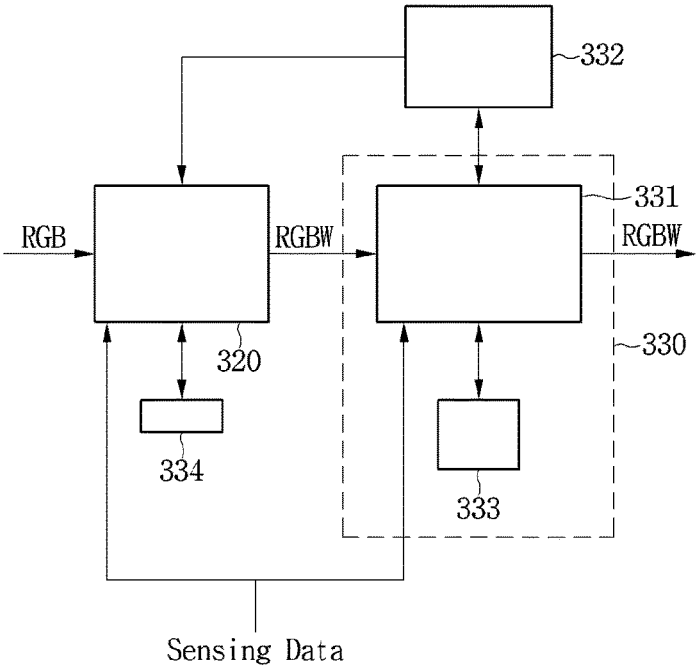
FIG. 11B is a detailed block diagram showing another example of the deterioration compensator in FIG. 7.

FIG. 11A is a detailed block diagram showing an example of the deterioration compensator in FIG. 8A. FIG. 11B is a detailed block diagram showing another example of the deterioration compensator in FIG. 8A.

Referring to FIG. 11A, the deterioration compensator 330 can include a data transform portion 331, a counter 332, a first memory 333 and a second memory 334.

The data transform portion 331 can compensate deteriorations of organic light emitting diodes OLED. To this end, the data transform portion 331 can transform input RGBW data signals into new RGBW data signal (i.e., compensated RGBW data signals).

The counter 332 can count a display period of the organic light emitting diode display device. For example, the counter 332 can obtain the display period by counting one of rising and falling edges of the vertical synchronous signal Vsync which is used as a reference timing signal representing a start time point (or an end time point) of a single frame image. With the exception of the vertical synchronous signal Vsync, one of system signals, such as a clock signal, a horizontal synchronous signal and so on, applied from the external graphic controller to the timing controller 124 can be used for counting the display period. Also, the counter 332 can count the display period in second, minute and hour units. The time information counted by the counter 332 can be divided into a short-term record and a long-term record. Also, the counter 332 can include additional memories which are used to store the time information and divided into a volatile memory and a non-volatile memory. For example, the short-term record of the time information can be stored in the volatile memory such as a DDR (Double data rate) memory and the long-term record of the time information can be stored in the non-volatile memory such as a NAND flash memory or others. In detail, the counter 332 can record the display period or the driving time whenever the organic light emitting diode display device is powered-on. Also, the counter 332 can write-down an accumulated display period from an initially (or a first) powered-on time point of the organic light emitting diode display device up to the present. To the end, the counter 332 can use one of a separated battery (or a dry battery) and a storage battery being charged by a power supply unit (not shown) of the organic light emitting diode display device. Moreover, it is determined by a selection of a user whether any one of the recorded time information is used The first memory 333 can store a look-up table including the target brightness values TBVs as represented in the Table 1. The second memory 334 can store a look-up table including the target color temperatures TCTs of the W data signal as represented in Table 2. The target color temperature TCT can become a target value of the color temperature of the W data voltage applied to a white pixel.

The data transform portion 331 can set the compensation brightness gain CBG on the basis of the sensing data, which applied from the exterior (i.e., one of the timing controller 124, the data driver 120 and the additional sensing driver), in a first step. Also, the data transform portion 331 can input the display period information from one of the counter 332 and the first and second memories 333 and 334 in a second step, and derive the target brightness value TBV (i.e., the time-rated target brightness value TBVk) from the set compensation brightness value CBG and the input display period information in a third step. In a fourth step, the data transform portion 331 can adjust (or compensate) brightnesses of the RGBW data signals, which are applied from one of the timing controller 124 and the external graphic controller, in order to match the brightness value of the deteriorated organic light emitting diode OLED with the derived target brightness value TBV. In detail, the data transform portion 331 can input the sensing data which includes deterioration information of the organic light emitting diode OLED and is applied from one of the timing controller 124, the data driver 120 and the additional sensing driver, and derive the compensation brightness gain CBG from the sensing data. Also, the data transform portion 331 can input the display period information which is counted by the counter 332, and read-out the target brightness value TBV (i.e., the time-rated target brightness value TBVk) corresponding to the compensation brightness gain CBG and the display period information from the first memory 333. Moreover, the data transform portion 331 can adjust brightnesses of the input RGBW data signals using the set compensation brightness gain CBG and the read-out target brightness value TBV. As such, the data transform portion 331 can compensate the deterioration of the organic light emitting diode OLED.

Such a data transform portion 331 can also performs: a first step of setting the compensation brightness gain CBG on the basis of the sensing data which is applied from one of the timing controller 124, the data driver 120 and the additional sensing driver; a second step of setting the color temperature compensation value CTCV of the W pixel on the basis of the compensation brightness gain CBG; a third step of inputting the display period information from the counter 332; a fourth step of setting the target color temperature TCT (i.e., the time-rated target color temperature TCTk) on the basis of the color temperature compensation value CTCV of the W pixel and the display period information; and a fifth step of transferring the set target color temperature TCT to the RGB-RGBW transform portion 320. In detail, the data transform portion 331 can input the display period information counted by the counter 332, read-out the target color temperature TCT of the W pixel opposite to the display period information and the set color temperature compensation value CTCV from the second memory 334, and transfer the read-out target color temperature TCT of the W pixel to the RGB-RGBW transform portion 320. Then, the RGB-RGBW transform portion 320 can adjust the color temperature of the W data signal using the target color temperature TCT and the color temperature compensation value CTCV when the W data signal is derived from the RGB data signals. In accordance therewith, the deterioration of the organic light emitting diode OLED used to display white can be compensated. Also, the color temperatures of the data signals applied to the green and blue pixels adjacent to the white pixel which receives the W data signal can be adjusted in the same procedure as the color temperature compensation of the W data signal. Therefore, a white spot (or a white image) displayed by the green, blue and white pixels can be compensated.

Referring to FIG. 11B, the data conversion unit 300 according to another example allows not only the deterioration compensator 330 to include only the data transform portion 331 and the first memory 333 but also the counter 332 and the second memory 334 to be disposed in a separated manner from the deterioration compensator 330, unlike that shown in FIG. 11A. In other words, the data conversion unit 300 can include a de-gamma portion 310, a RGB-RGBW transform portion 320, a deterioration compensation 330, a counter 332 and a second memory 334.

The data transform portion 331 included in the deterioration compensator 330 can set the compensation brightness gain CBG on the basis of the sensing data applied from the exterior (one of the timing controller 124, the data driver 120 and the additional sensing driver. Also, the data transform portion 331 can periodically read-out the target brightness value TBV corresponding to the compensation brightness gain CBG and the display period information of the counter 322 from the look-up table, such as Table 1, which includes the target brightness values TBVs and is stored in the first memory 333. Moreover, the data transform portion 331 can adjust the brightnesses of the RGBW data signals, which are applied from the RGB-RGBW transform portion 320, using the compensation brightness gain CBG and the periodically read-out target brightness value TBV.

On the other hand, the RGB-RGBW transform portion 320 can set the compensation brightness gain CBG on the basis of the sensing data applied from the exterior (one of the timing controller 124, the data driver 120 and the additional sensing driver), and derive the color temperature compensation value CTCV from the compensation brightness gain CBG. Also, the RGB-RGBW transform portion 320 can input the courted display period information from the counter 332 and periodically read-out the target color temperature TCT of the W pixel corresponding to the display period information and the color temperature compensation value CTCV from a look-up table, such as Table 2, which includes the target color temperatures TCTs of the W pixel and is stored in the second memory 334. Moreover, the RGB-RGBW transform portion 320 can adjust the color temperature of the W data signal using the color temperature compensation value CTCV and the periodically read-out target color temperature TCT of the W pixel when the W data signal is derived from the RGB data signal applied from the exterior (one of the timing controller 124 and the external graphic controller).

The first and second memories 333 and 334 are disposed in a separated manner from each other, but they are not limited to this. Alternatively, a single memory can be used to store the target brightness values TBVs, which are differently set on the basis of the display period, and the target color temperatures TCTs which are differently set on the basis of the display period.

Figure 12:
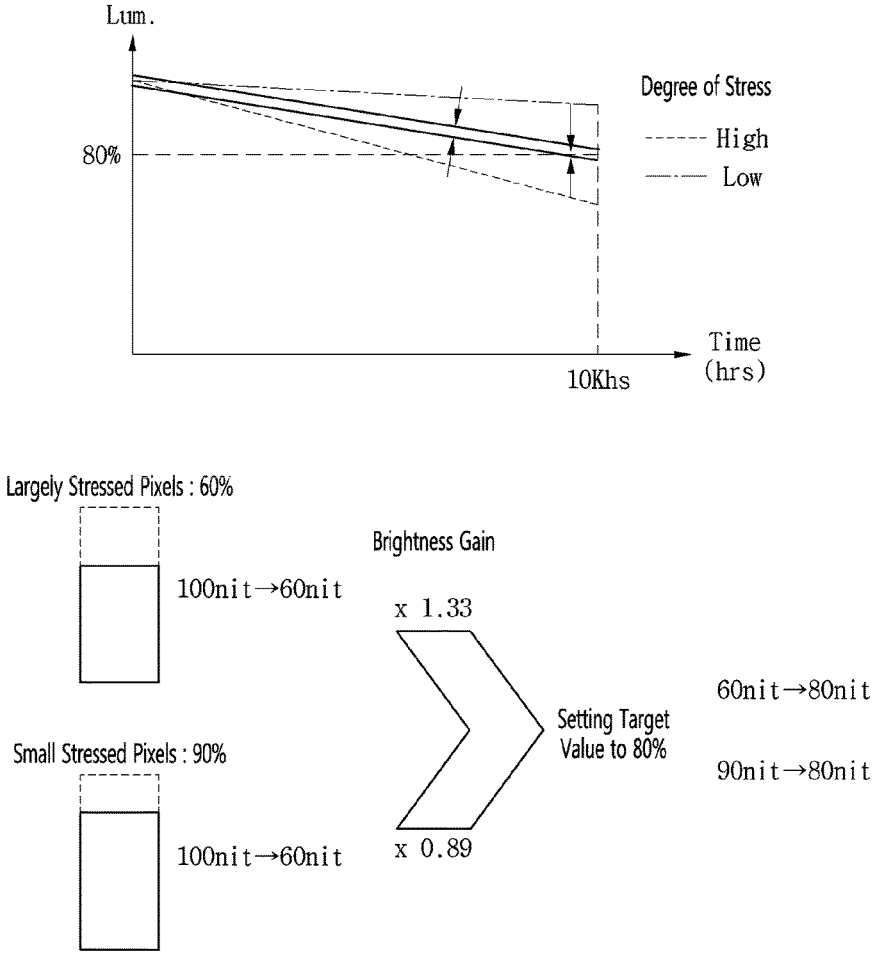
FIG. 12 is a data sheet illustrating a brightness control method which uses a target brightness value in accordance with an embodiment of the present disclosure.
Figure 13:
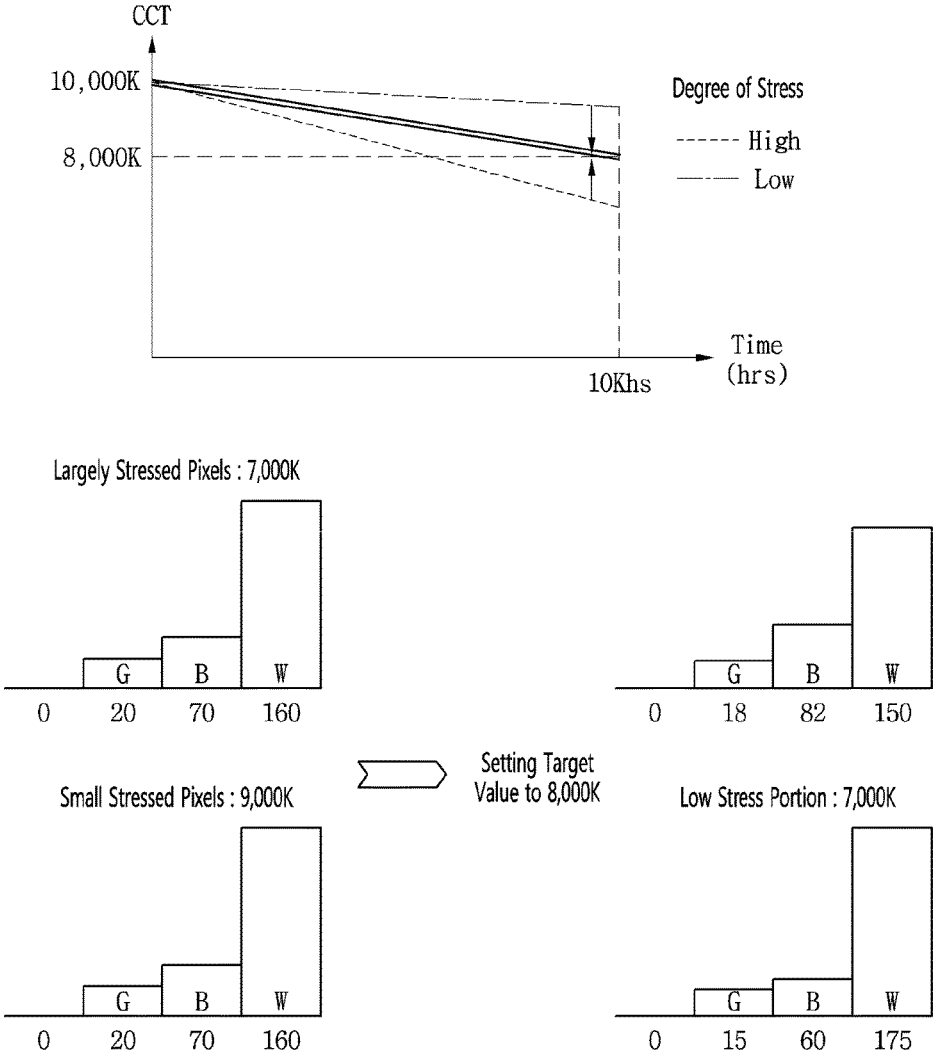
FIG. 13 is a data sheet illustrating a method of controlling a color temperature of white data using a target color temperature of white data in accordance with an embodiment of the present disclosure.

FIG. 12 is a data sheet illustrating a method of controlling brightness of a pixel using a target brightness value in accordance with an embodiment of the present disclosure. FIG. 13 is a data sheet illustrating a method of controlling a color temperature of a white pixel using a target color temperature of a white pixel in accordance with an embodiment of the present disclosure.

Referring to FIG. 12, the target brightness value TCT can be used as a compensation reference for compensating decreased brightnesses of the pixel which are caused by the deteriorations, and set in a manner varying with the display period. Also, the brightness components of the data signals applied to the pixels can be compensated on the basis of the compensation brightness gain CBG and the target brightness value. In accordance therewith, the brightness values of the deterioration-compensated pixels in accordance with the display period can be matched with the target brightness value TCT. In detail, the brightness value of the data signal applied to a pixel which is largely deteriorated by a relatively large stress and has a largely decreased brightness value can be increment-compensated. On the contrary, the brightness value of the data signal applied to another pixel which is small deteriorated by a relatively low stress and has a small decreased brightness value can be decrement-compensated. The brightness values of the small deteriorated pixel and the largely deteriorated pixel can be matched with the target brightness value TCT.

For example, as shown in FIG. 12, not only a largely stressed pixel can have a brightness value of about 60 nit which is largely decreased from 100 nit corresponding to a brightness value of its initial state without any deterioration but also a small stressed pixel can have a brightness value of 90 nit which is small decreased from 100 nit corresponding to the brightness value of its initial state without any deterioration. In this case, the compensation brightness gain CBG of about 1.66 which will be used in the deterioration compensation of the largely stressed pixel can be obtained from the sensed data, the compensation brightness gain CBG of about 1.11 which will be used in the deterioration compensation the small stressed pixel can be obtained from the sensing data, and the target brightness value TCT of the display panel 116 can be set to be 80%. Then, not only the brightness component of the data signal applied to the largely stressed pixel can be compensated with a lowered compensation brightness gain of about 1.33 corresponding to 80% of the obtained compensation brightness gain of about 1.66, but also the brightness component of the data signal applied to the small stressed pixel can be compensated with a lowered compensation brightness gain of about 0.89 corresponding to 80% of the obtained compensation brightness gain of about 1.11. As such, both of the largely and small stressed pixels can have a brightness value of 80 nit. In other words, the brightness value of the largely stressed pixel is increased from 60 nit to 80 nit but the brightness value of the small stressed pixel is decreased from 90 nit to 80 nit.

On the other hand, the related art bottom-up compensation method enables the brightness components of the data signals applied to the largely stressed pixel and the small stressed pixel to be compensated with the compensation brightness gains of 1.66 and 1.11. Then, both of the largely and small stressed pixels can maintain the brightness value of 100 nit. On the contrary, the related art top-down compensation method forces not only the brightness component of the data signal applied to the small stressed pixel to be compensated with a compensation brightness gain of about 0.67. Then, both of the largely and small stressed pixels can have the relatively brightness value of 60 nit.

In this manner, the present disclosure can not only allow the largely and small stressed pixels to be brightness-compensated with the relatively lower compensation brightness gains of 1.33 and 0.89 compared to the compensation brightness gains of 1.66 and 1.11 in the related art bottom-up compensation method, but also the brightness values of the largely and small stressed pixels to be maintained 80 nit higher than 60 nit of the related art top-down compensation method. As such, the present disclosure can prevent the excessive stress state of each pixel (or each organic light emitting diode OLED) and the brightness decrement below a desired brightness range. In accordance therewith, the present disclosure can maintain a relatively high brightness without any non-controllable state due to the high (or excessive) stress. Therefore, the present disclosure can prevent the overcompensation and the lifespan reduction and maintain the same image quality regardless of the deteriorated degree of each pixel.

Similarly, as shown in FIG. 13, not only the color temperature of a largely stressed white pixel can be largely lowered from 10,000K, which corresponds to the color temperature of its initial state without any deterioration, to 7,000K but also the color temperature of a small stressed white pixel can be small lowered from 10,000K, which corresponds to the color temperature of the its initial state without any deterioration, to 9,000K. In this case, the target color temperature TCT of the white pixels can be set to be 8,000K. Also, the color temperature of the W data signal applied to the largely stressed white pixel can be increment-compensated on a relatively large color temperature compensation value CTCV, which is obtained from the sensing data, and the target color temperature TCT, but the color temperature of the W data signal applied to the small stressed white pixel can be decrement-compensated on a relatively small color temperature compensation value CTCV and the target color temperature. Then, both of the color temperatures of the largely and small stressed white pixels can be matched with the target color temperature of 8,000K not the initial color temperature of 10,000K. In other words, the color temperature of the largely stressed white pixel can rise from 7,000K to 8,000K, but the color temperature of the small stressed white pixel can fall from 9,000K to 8,000K. As such, the present disclosure can reduce the stresses of the white pixels (or the white organic light emitting diode OLED) and prevent a falling of the color temperature of the white pixel below a desired color temperature range. In accordance therewith, the present disclosure can allow the white pixels (or the white organic light emitting diode OLED) to maintain a relatively high color temperature without any non-controllable state due to the high (or excessive) stress. Therefore, the present disclosure can prevent the overcompensation and the lifespan reduction and maintain the same image quality regardless of the deteriorated degree of each white pixel.

Moreover, the color temperatures of the data signals applied to the green and blue pixels adjacent to the white pixel which receives the W data signal can be adjusted in the same procedure as the color temperature compensation of the W data signal. As such, the present disclosure can reduce the stresses of the green and blue pixels (or the green and blue organic light emitting diodes OLED) and prevent a falling of the color temperature of the green and blue pixels below a desired color temperature range. In accordance therewith, the present disclosure can allow the green and blue pixels (or the green and blue organic light emitting diodes OLED) to maintain a relatively high color temperature without any non-controllable state due to the high (or excessive) stress. Therefore, the present disclosure can prevent the overcompensation and the lifespan reduction and maintain the same image quality regardless of the deteriorated degrees of green and blue pixels. Furthermore, a white spot displayed by the green, blue and white pixels can be compensated.

As described above, the organic light emitting diode display device of the present disclosure can set a target value included in a value range of its specification and perform the deterioration compensation suitable for its specification. In accordance therewith, images displayed on the display panel can maintain the same quality. In other words, since the deterioration compensation can be always performed using a compensation value or gain in accordance with the target value, the display panel can maintain the same quality regardless of the deteriorated degrees of pixels. Also, the excessive deterioration compensation and the lifespan reduction can be prevented by reducing the stresses of the pixels (or the organic light emitting diodes) and maintaining relatively brightness and color temperature. In detail, not only the generation of a non-controllable state due to the high (or excessive) stress in the related art bottom-up compensation method can be prevented but also the brightness decrement and the falling of the color temperature below the desired range in the related art top-down compensation method can be solved. Therefore, the lifespan reduction can be prevented, relatively high brightness and color temperature can be maintained, and the stress can be minimized.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents without being limited to the description of the present disclosure.

What is claimed is:

1. An organic light emitting diode display device comprising:

a timing controller configured to transform red (hereinafter, 'R') green (hereinafter, 'G') blue (hereinafter, 'B') data signals into R, G, B and white (hereinafter, 'W') data signals, and to set a color temperature compensation value of a white pixel (hereinafter, "W pixel") on the basis of a deteriorated degree of the W pixel; and a memory configured to store the color temperature compensation value of the W pixel and a plurality of target color temperatures which are based on the color temperature compensation value, each target color temperature being time-rated based on a display period of the organic light emitting diode display device, wherein the timing controller reads out one of the time-rated target color temperatures of the W pixel from the memory by a data transform portion therein, based on the color temperature compensation value of the W pixel and the display period, wherein the timing controller matches the color temperature of the W pixel with the read-out time-rated target color temperature of the W pixel by a RGB-RGBW transform portion therein.

2. The organic light emitting diode display device of claim 1, wherein the color temperature compensation value of the W pixel is set on the basis of a compensation brightness gain which is derived from the deteriorated degree of the W pixel and used for compensating brightness of the W pixel with that of an initial state thereof.

3. The organic light emitting diode display device of claim 2, wherein the time-rated target color temperatures of the W pixel are included in a color temperature range of the W pixel which are disclosed in a specification of the organic light emitting diode display device.

4. The organic light emitting diode display device of claim 1, wherein the time-rated target color temperatures are stored into the memory in a look-up table shape.

5. The organic light emitting diode display device of claim 4, further comprises a counter configured to count the display period of the organic light emitting diode display device.

6. The organic light emitting diode display device of claim 5, wherein the counter counts the display period using a vertical synchronous signal.

7. A method of driving an organic light emitting diode display device comprising:

transforming red ('R'), green, ('G'), and blue ('B') data signals into R, G, B and white ('W') data signals;

setting a color temperature compensation value of a white pixel ("W pixel") on the basis of a deteriorated degree of the W pixel; and storing, in a memory, the color temperature compensation value of the W pixel and a plurality of target color temperatures which are based on the color temperature compensation value, each target color temperature being time-rated based on a display period of the organic light emitting diode display device, wherein one of the time-rated target color temperatures of the W pixel is read out from the memory, based on the color temperature compensation value of the W pixel and the display period; and matching the color temperature of the W pixel with the read-out time-rated target color temperature of the W pixel.

* * * * *